US010019972B2

(12) United States Patent
Poschelk

(10) Patent No.: US 10,019,972 B2
(45) Date of Patent: Jul. 10, 2018

(54) TREMOLO ASSEMBLY

(71) Applicant: KK POSCHELK PTY LTD, Queensland (AU)

(72) Inventor: Kevin Poschelk, Queensland (AU)

(73) Assignee: KK POSCHELK PTY LTD., Queensland (AU)

( * ) Notice: Subject to any disclaimer, the term of this patent is extended or adjusted under 35 U.S.C. 154(b) by 18 days.

(21) Appl. No.: 15/117,020

(22) PCT Filed: Feb. 11, 2015

(86) PCT No.: PCT/AU2015/000073
§ 371 (c)(1),
(2) Date: Aug. 5, 2016

(87) PCT Pub. No.: WO2015/120503
PCT Pub. Date: Aug. 20, 2015

(65) Prior Publication Data

US 2017/0178603 A1 Jun. 22, 2017

(30) Foreign Application Priority Data

Feb. 14, 2014 (AU) ..... 2014900458

(51) Int. Cl.
*G10D 3/14* (2006.01)
*G10D 3/04* (2006.01)

(52) U.S. Cl.
CPC ..... *G10D 3/146* (2013.01); *G10D 3/04* (2013.01)

(58) Field of Classification Search
CPC ..... G10D 3/04
See application file for complete search history.

(56) References Cited

U.S. PATENT DOCUMENTS

| | | | | |
|---|---|---|---|---|
| 4,939,971 | A | 7/1990 | Satoh | |
| 6,384,311 | B1 | 5/2002 | Cola | |
| 7,479,592 | B1 | 1/2009 | Slavik | |
| 2001/0002570 | A1* | 6/2001 | McCabe | G10D 3/146 84/312 R |
| 2003/0110920 | A1 | 6/2003 | Ito et al. | |

OTHER PUBLICATIONS

International Search Report for International Patent Application No. PCT/AU2015/000073 dated Apr. 27, 2015.

* cited by examiner

*Primary Examiner* — Kimberly Lockett
(74) *Attorney, Agent, or Firm* — Wegman, Hessler & Vanderburg

(57) ABSTRACT

The invention is directed to a tremolo assembly for a guitar that returns the tremolo to the neutral position after use irrespective of the tension between the strings and the balancing spring and reduces the problems associated with string stretch and maintaining tune and string breakage. The tremolo assembly includes a bridge tension arrangement, a controller arm and controller arm stop, and a controller arm tension arrangement.

27 Claims, 5 Drawing Sheets

22
19
13
20
18
31
43
38

25
22
20
18
31
43
38

22
19
18
20
43
31
38

TREMOLO ASSEMBLY

CROSS-REFERENCE TO RELATED APPLICATIONS

This application is a national phase of International Patent Application No. PCT/AU2015/000073 filed Feb. 11, 2015, which is incorporated herein by reference in its entirety, and which claims the priority filing benefit of Australian Provisional Patent Application No. AU2014900458 filed Feb. 14, 2014.

FIELD OF INVENTION

The present invention relates to a tremolo for use with stringed musical instruments. The present invention has particular but not exclusive application for use on an electric guitar.

BACKGROUND OF THE INVENTION

A tremolo is a device which, when fitted to a stringed instrument, allows the player of the instrument to lower or raise the pitch of a note or chord. The device is commonly used with an electric guitar, and is sometimes referred to as a whammy bar or vibrato. Use of the tremolo allows a guitarist to temporarily increase or decrease the tension on the strings thereby to raise or lower the pitch.

Electric guitars are made with a neck and a body and a bridge. The bridge is usually fixed or a floating tremolo bridge or some other style of tremolo bridge. On guitars fitted with floating tremolo bridges the strings are attached to the tremolo bridge and drawn across the body and neck over a nut and fixed to an individual machine head. The strings are tensioned and tuned to pitch by the machine heads before the guitar is played. The tremolo includes the floating tremolo bridge pivotally attached to the guitar body. The tremolo also includes a lever that can be moved upwards and downwards to pivot the tremolo bridge. The tremolo is maintained in balanced position by the tensioned strings and one or more opposing balancing springs.

However, continuous use of the tremolo may cause stretching of the guitar strings. If the strings are overstretched, they will become plastically deformed and may not return to the original tuned pitch. If overstretched the strings may even break. With guitars employing existing tremolo mechanisms, if one of the guitar strings breaks or is plastically deformed, the balancing spring in the tremolo will pull on and increase the tension on the remaining strings causing the remaining strings to play at a higher pitch than originally tuned. Furthermore, springs operating the tremolo may also become stretched overtime, and therefore have the effect of lowering the strings' pitch. The guitars fitted with tremolo devices therefore often require more frequent retuning.

Furthermore, some guitarists bend strings as part of their playing technique. This technique involves the guitarist using their fingers to push the strings significantly out of line to raise the tension and increase the pitch of the strings. If the guitar is fitted with a "floating bridge" tremolo, the "bending" of one or more of the guitar strings will cause pulling on the bridge causing the unbent strings to lose tension. This results in the non-bent strings playing at a lower pitch than the originally tuned pitch.

When guitar strings are plucked they will vibrate to produce sound. The amplitude of these sound vibrations reduces with time. The length of time that these vibrations continue after the strings are plucked is known as the sustain time. The sustain time is reduced when these vibrations are damped. In the situation where the strings have been stretched or have lost tension from continuous use of the tremolo or when the guitarist employs string bending techniques, the sustain time for the affected strings maybe shortened.

Strings change pitch when their length and their tension are altered. For the guitar strings to maintain their tuned pitch, it is important that the neck and body remain dimensionally stable and rigid under normal playing conditions. Because they are flexed and stretched when they are plucked, it is equally important that the strings are free to move unrestricted over the nut and saddles and that they negotiate as few hard bends as possible along their length. It is further important that the strings do not bind up at any point along their length.

It is also important that the tremolo bearings are as friction free as possible and do not bind up in any operating position.

Existing tremolos suffer a number of problems as described above, and do not exhibit ideal characteristics such as maintaining the pre-existing in tune string pitch after the use of the tremolo. If any one string loses pitch it will cause all others to change pitch in response. This requires guitarists to constantly retune their guitars to address these problems. Constant retuning is time consuming and lessens the enjoyment of playing the instrument, and is impractical as a long term solution.

OBJECT OF THE INVENTION

It is an object of the present invention to provide a tremolo that overcomes at least in part one or more of the above-mentioned problems.

SUMMARY OF THE INVENTION

The present invention was developed from the realisation that returning the strings (and tremolo) to the tuned or neutral position was dependent on the tension between the strings and the balancing spring of the tremolo and as the strings or balancing spring could be over stretched it was difficult to maintain a tuned instrument. Consequently a controlling mechanism was developed to return the tremolo to the neutral position after use irrespective of the tension between the strings and the balancing spring.

The present invention broadly resides in a tremolo assembly for a guitar including

- a tremolo chassis;
- a bridge pivotally attached to the tremolo chassis, said bridge includes a saddle and a plurality of ferrules for guiding and securing strings;
- bridge tension arrangement connecting the tremolo chassis to the bridge and providing balancing tension with the strings;
- a controller arm pivotally attached to the tremolo chassis and engaged with the bridge;
- a controller arm stop member to locate the controller arm and engaged bridge in a neutral position;
- controller arm tension arrangement connecting the controller arm to the tremolo chassis and urging the controller arm towards the controller arm stop member; and
- an activation member to pivot the bridge between upward and downward positions relative to the tremolo chassis, wherein the controller arm in cooperation with the controller arm stop member and the controller arm tension arrangement can be engaged with the bridge to locate the bridge to the neutral position after pivoting between the upward and downward positions.

The plurality of ferrules are preferably substantially adjacent or proximal to the saddle and positioned so that the strings are subject to minimal bending.

The bridge is preferably substantially T-shaped with a laterally extending engagement portion near one end. Said engagement portion is preferably shaped to abut and engage with the controller arm.

The bridge tension arrangement preferably includes a bridge spring attached to the bridge. The bridge spring is preferably connected to a bridge spring adjustment member which is attached to the tremolo chassis. The tension of the bridge spring is preferably adjustable by adjusting the bridge spring adjustment member.

The controller arm is preferably pivotally connected to the bridge and the tremolo chassis. Preferably the pivotal connection of the controller arm is the same pivotal connection between the bridge and the tremolo chassis.

The controller arm stop member is preferably attached to the tremolo chassis. The controller arm stop member is preferably adjustable.

The controller arm tension arrangement preferably includes a controller arm spring attached to the controller arm. The controller arm spring is preferably connected to a controller arm spring adjustment member which is attached to the tremolo chassis. The tension of the controller arm spring is preferably adjustable by adjusting the controller arm spring adjustment member. The controller arm spring adjustment member can preferably be adjusted to substantially prevent movement of the controller arm and thus movement of the engaged bridge. More preferably the controller arm spring adjustment member can be adjusted to substantially prevent movement of the controller arm and thus upward movement of the engaged bridge.

Preferably the bridge tension arrangement is adjusted so that the engaged bridge is in the neutral position when the strings are tuned. Preferably the bridge tension arrangement is adjusted so that the engaged bridge is in the neutral position abutting the controller arm when the strings are tuned.

Preferably the tension of the controller arm tension arrangement is large enough to both overcome any mechanical friction and to ensure the controller arm will urge the bridge to return to the neutral position.

Preferably the tension of the bridge tension arrangement is adjusted to balance the tension of the strings so that the bridge in an upward pivotal position can return to the neutral position.

The activation member is preferably a bar or elongate member extending from the bridge. Alternatively the activation member is preferably a handle forming part of the bridge. The tremolo assembly may include two or more activation members.

The tremolo chassis is preferably attached to the neck of the guitar by a plurality of screws or metal inserts and bolts.

Preferably the tremolo assembly as described above can be retro-fitted to guitars.

In a further embodiment the present invention broadly resides in a tremolo assembly for a guitar including a tremolo chassis;

a bridge pivotally attached to the tremolo chassis, said bridge includes a saddle and a plurality of ferrules for guiding and securing strings;

bridge tension arrangement connecting the tremolo chassis to the bridge and providing balancing tension with the strings;

a controller arm pivotally attached to the tremolo chassis and engaged with the bridge;

a controller arm stop member to locate the controller arm and engaged bridge in a neutral position;

controller arm tension arrangement connecting the controller arm to the tremolo chassis and urging the controller arm towards the controller arm stop member; and an activation member to pivot the bridge between upward and downward positions relative to the tremolo chassis, wherein the tension of the controller arm tension arrangement is large enough to overcome any mechanical friction and will ensure the controller arm will urge the bridge to return to the neutral position, and the tension of the bridge tension arrangement is adjusted to balance the tension of the strings so that the bridge in an upward pivotal position can return to the neutral position.

Preferably the controller arm in cooperation with the controller arm stop member and the controller arm tension arrangement can be engaged with the bridge to locate the bridge to the neutral position after pivoting between the upward and downward positions.

In another embodiment the present invention is a tremolo assembly kit including a tremolo chassis;

a bridge pivotally attached to the tremolo chassis, said bridge includes a saddle and a plurality of ferrules for guiding and securing strings;

bridge tension arrangement connecting the tremolo chassis to the bridge and providing balancing tension with the strings;

a controller arm pivotally attached to the tremolo chassis and engaged with the bridge;

a controller arm stop member to locate the controller arm and engaged bridge in a neutral position;

controller arm tension arrangement connecting the controller arm to the tremolo chassis and urging the controller arm towards the controller arm stop member; and an activation member to pivot the bridge between upward and downward positions relative to the tremolo chassis.

In another aspect the invention broadly resides in a stringed instrument using the tremolo assembly as described above.

In a further aspect the invention broadly resides in a guitar including tremolo assembly as described above, guitar body and a guitar neck. In another aspect the invention resides in a guitar having the tremolo assembly as described above.

BRIEF DESCRIPTION OF THE DRAWINGS

In order that the present invention can be more readily understood and put into practical effect, reference will now be made to the accompanying drawings wherein.

DETAILED DESCRIPTION OF THE PREFERRED EMBODIMENTS

Figure 1:
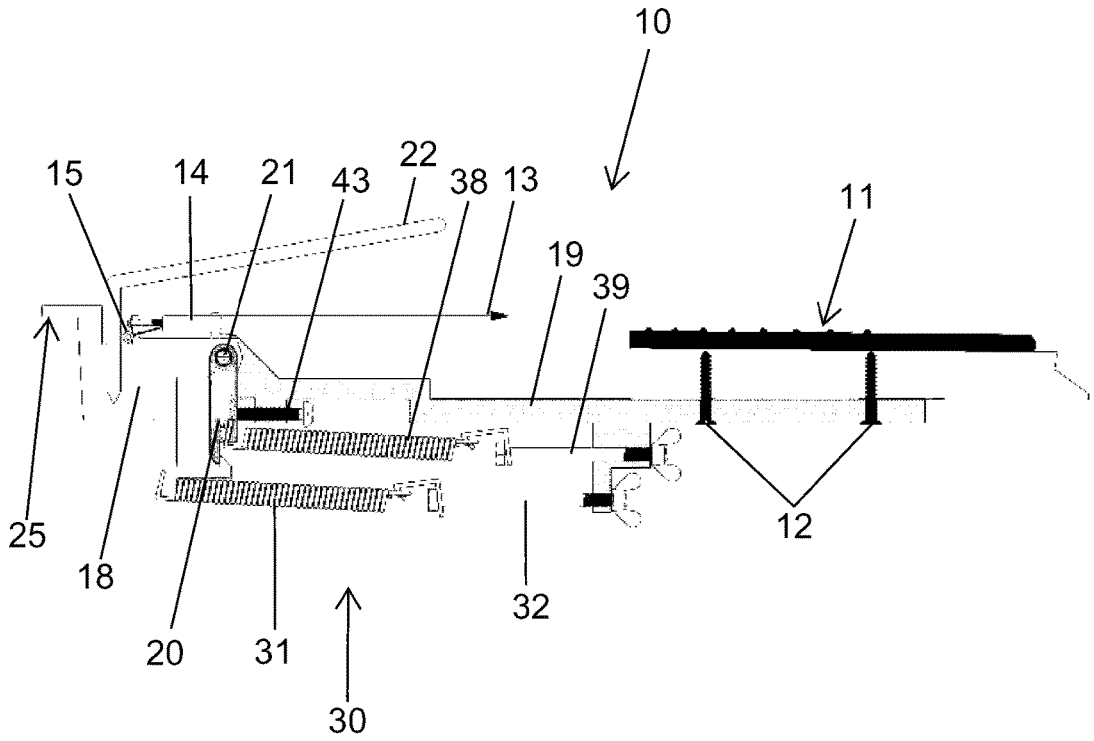
FIG. 1 is a diagrammatic view of the tremolo assembly.
Figure 2:
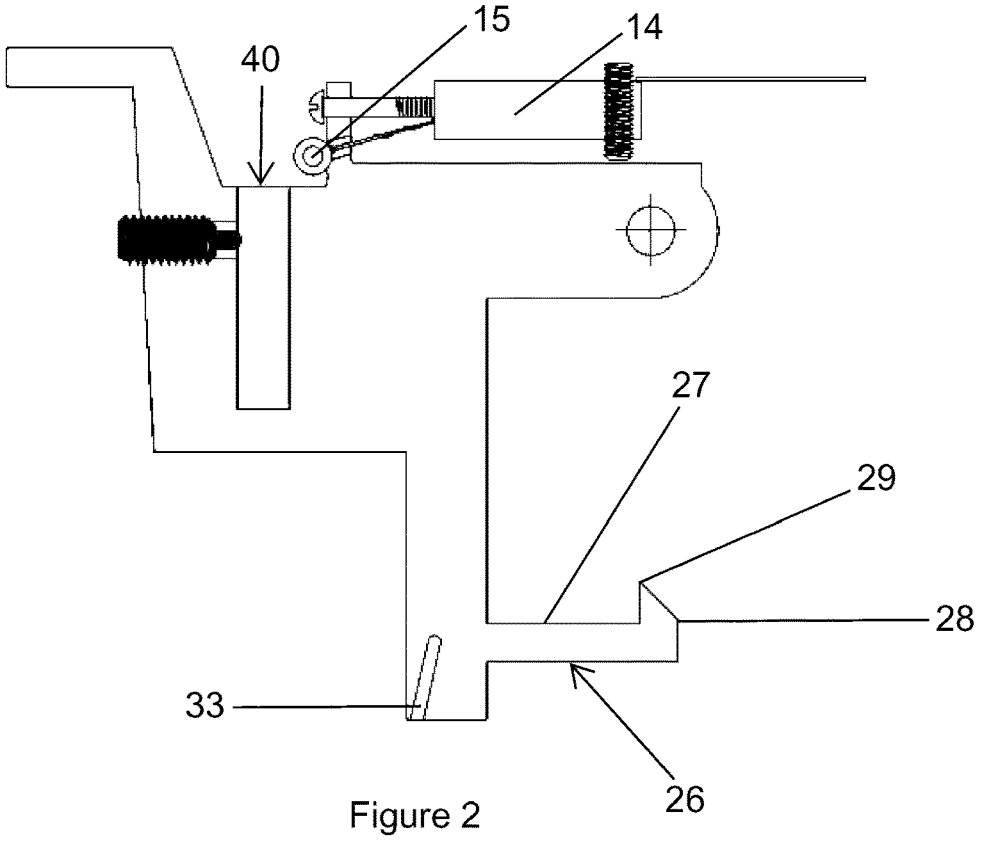
FIG. 2 is a diagrammatic view of the bridge.
Figure 3:
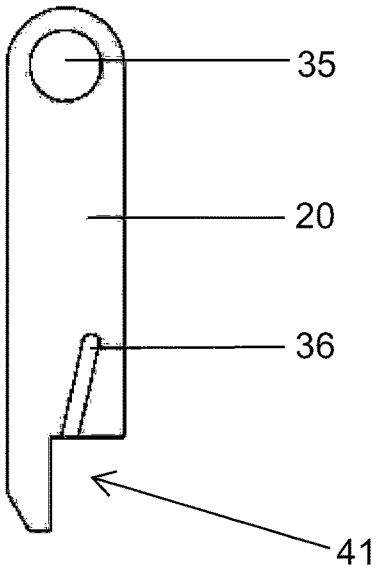
FIG. 3 is a diagrammatic view of the controller arm.

With reference to FIG. 1, there is shown a tremolo assembly 10 fixed to a guitar neck 11 by screws 12. There is also shown a string(s) 13 guided through saddle 14 and fixed to ferrule(s) 15. The ferrule(s) 15 is substantially adjacent to the saddle 14 and causes the string 13 to bend only slightly as it passes from the saddle 14. Most guitars will have six strings and consequently there will be six ferrules 15 associated with and in close proximity to the saddle 14. To reduce the possibility of string stretch and wear and frequent string breakage the string 13 is passed over the saddle 14 to its ferrule 15 with a bend of the string 13 through the tremolo assembly 10 of less than thirty degrees.

The tremolo assembly 10 includes a bridge 18, tremolo chassis 19 and controller arm 20. The bridge 18 is pivotally attached to the tremolo chassis 19 and controller arm 20 so that the bridge 18 and controller arm 20 can move independent of each other and the tremolo chassis 19. The bridge 18, controller arm 20 and tremolo chassis 19 are pivotally attached to each other via tremolo axle 21. In other embodiments a different form of pivotal attachment may be used rather than rotating about the tremolo axle.

Figure 7:
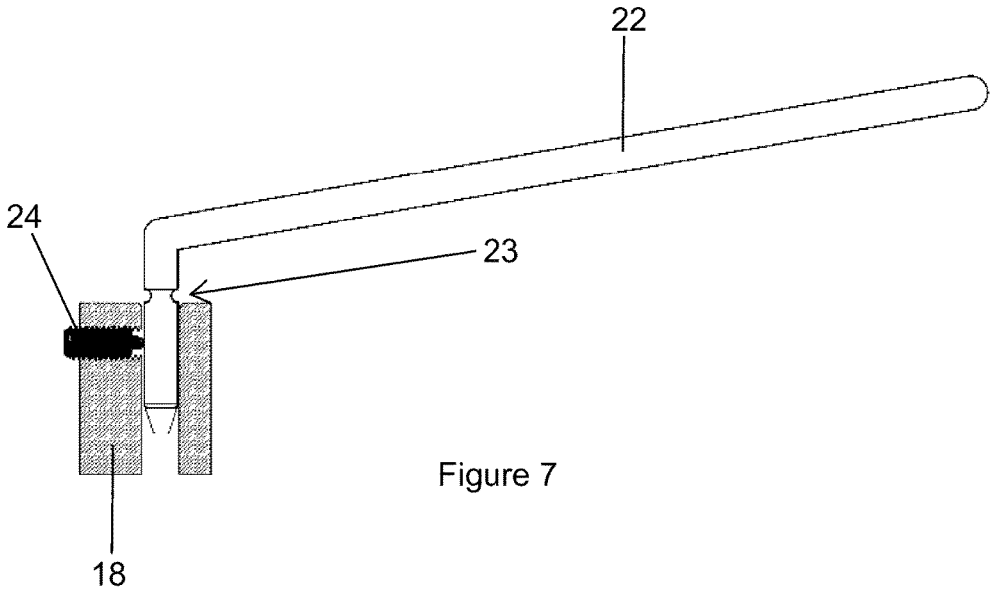
FIG. 7 shows the positioning of the tremolo arm.

The bridge 18 includes the mounted saddle 14 and ferrule (s) 15. The bridge 18 has a recess 40 in which the tremolo arm 22 can be positioned. With reference to FIG. 7, the tremolo arm 22 has a notch 23 near one end that serves to locate the tremolo arm 22 within the bridge 18. A grub screw 24 can be inserted in a threaded opening (not shown) in the bridge 18 to engage the notch 23 of the tremolo arm 22. In another embodiment, the bridge may have a further opening through which a grub screw can be inserted to prevent movement of the tremolo arm about a vertical axis while permitting the bridge to move about the horizontal axis.

The bridge 18 may include a handle portion 25 that is spaced from the mounted saddle 14. The handle portion 25 is an alternate tremolo activation member. With the handle portion 25 forming part of the bridge 18, it is not necessary to have the tremolo arm 22.

The bridge 18 includes an engagement portion 26 that engages with the controller arm 20. The engagement portion 26 includes a laterally extending leg 27 with a flange 28. The flange 28 has an abutment side 29 for engagement with the controller arm 20.

The bridge 18 is connected to a bridge adjustment mechanism 30 which includes a bridge spring 31 and bridge adjustment fastener 32. The bridge spring 31 is engaged at one end within recess 33 within the bridge 18 and at an opposite end to the bridge adjustment fastener 32. The bridge adjustment fastener 32 passes through an aperture (not shown) in the tremolo chassis 19. Tension provided by the bridge adjustment mechanism 30 can be increased by adjusting the position of the bridge adjustment fastener 32. In practice, the tension of the adjustment mechanism 30 is adjusted with respect to the tension of the strings 13.

The controller arm 20 includes an aperture 35 through which the tremolo axle 21 is inserted. The controller arm 20 also has a recess 36 for the positioning and engagement of one end of a controller arm spring 38. The controller arm spring 38 is engaged at another end to a controller arm adjustment fastener 39. The tension in the controller arm spring 38 is adjusted by the controller arm adjustment fastener 39.

The controller arm 20 has an engagement portion 41 that can engage and abut abutment side 29 of the bridge 18.

There is also a controller arm stop 43 connected to the tremolo chassis 19 and serves to abut the controller arm 20. The controller arm stop 43 can be adjusted to locate the controller arm 20 to any predetermined position. The controller arm 20 is positioned by the controller arm stop 43 and this controller arm 20 position predetermines the bridge 18 position and establishes the bridge's neutral position for the tuning of the strings 13. At this neutral position the individual strings 13 are brought into tune by adjusting their tension by operating the guitar strings individual machine heads. The controller arm 20 in the neutral position abuts the controller arm stop 43 and is maintained in this position by the tension of the controller arm spring 38 and controller arm adjustment fastener 39. The tension of the controller arm spring 38 is adjusted to ensure that mechanical friction is also overcome.

The engagement portion 41 of the controller arm 20 and the engagement portion 29 of the bridge 18 may include a buffering material or mechanism to reduce the noise that may occur when the bridge 18 and the control arm 20 come into contact. Similarly a buffering material or mechanism may be used to quiet the contact between the controller arm 20 and the controller arm stop 43. The controller arm 43 may be made of, for example, Nylon.

Figures 4, 5, 6:
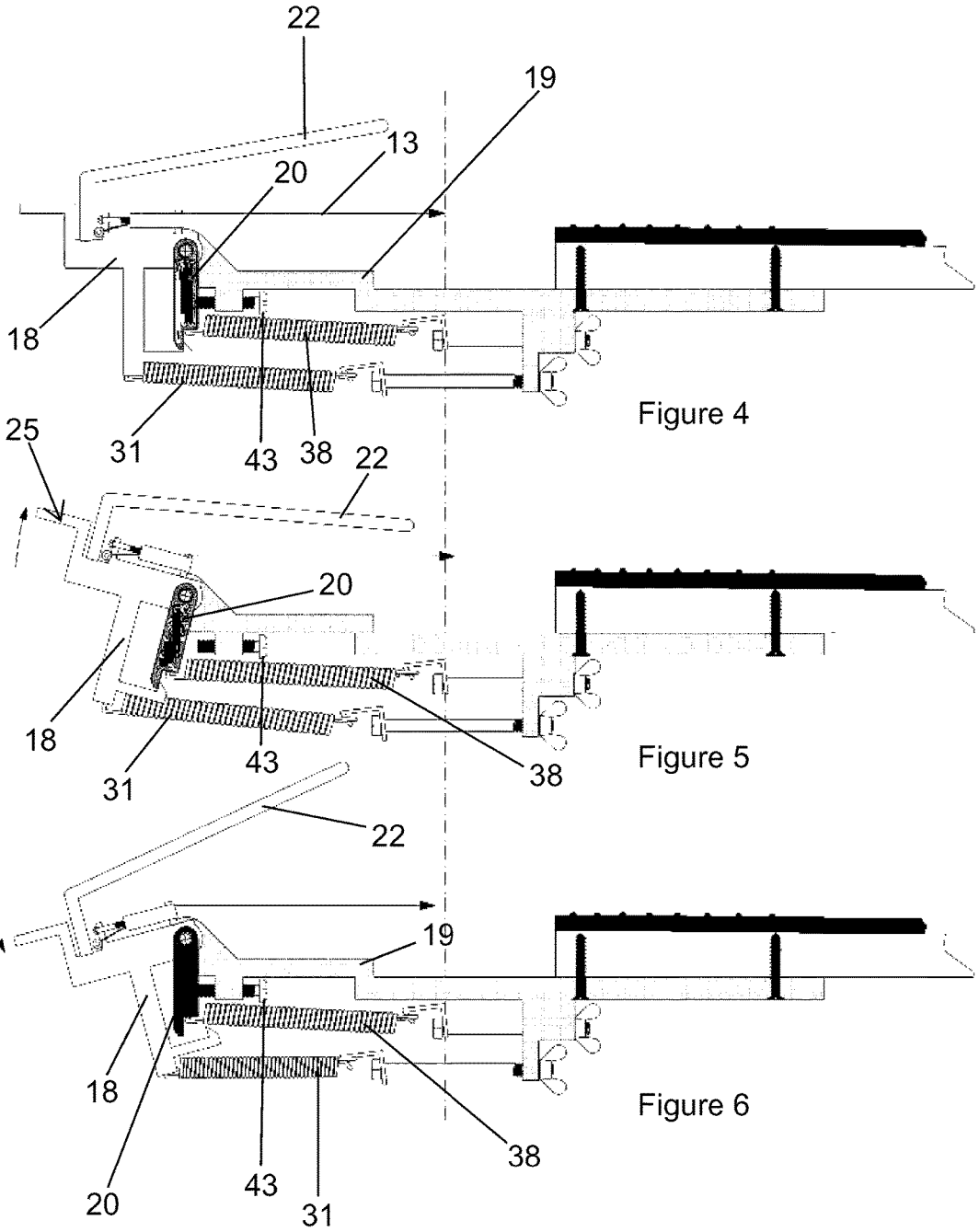
FIGS. 4 to 6 are diagrammatic views of the tremolo assembly in the neutral position, downward bridge position, upward bridge position respectively.

With reference to FIGS. 4, 5 and 6, the tremolo assembly 10 serves to return or locate the bridge 18 to its neutral position after use of the tremolo. FIG. 4 shows the tremolo assembly 10 in the neutral position where the controller arm 20 both engages the bridge 18 and is in contact with the controller arm stop 43, maintaining the position of the bridge 18 by the tension of the controller arm spring 38 and controller arm adjustment fastener 39. In the neutral position, the strings 13 are tuned to pitch. The tension of the bridge spring 31 is of a magnitude to just maintain the balance of the bridge mechanism against the tension of the strings 13. The tension in the controller arm spring 38 is adjusted up enough to overcome the frictional resistance of the pivot mechanism of the bridge 18 and to bring the control arm 20 into light contact with controller arm stop 43. More tension may be used in the controller arm spring 38 to give the guitar a "Hard Tail" feel. A "Hard Tailed" stringed instrument is a stringed instrument that has a fixed bridge, attached in some way to the body away from the neck of the instrument.

As illustrated in FIG. 5, when the tremolo arm 22 is moved downwards, the bridge 18 pivots upward. The controller arm 20 pivots upward with the bridge 18 as it remains engaged with the bridge 18. The strings 13 relax. The strings 13 will have a lower pitch when relaxed. When the tremolo arm 22 is released, the tension of the controller arm spring 38 and the bridge springs 31 bring the controller arm 20 and engaged bridge 18 back to the neutral position whereby the strings regain their previously tuned pitch.

As illustrated in FIG. 6, when the tremolo arm 22 is moved upwards, the bridge 18 pivots downward. The controller arm 20 remains in position as it cannot move with the bridge 18 because of the controller arm stop 43. The strings 13 are stretched and have a higher pitch when played. When the tremolo arm 22 is released, the tension in the strings 13 forces the bridge 18 to rotate upwardly until it again engages with the controller arm 20. The tension of the controller arm spring 38 helps to stop the tremolo mechanism being pulled past the neutral position. When the bridge 18 returns and engages with the controller arm 20 in the neutral position, the strings 13 have returned to their earlier tuned position.

A locking mechanism such as a wedge, latch, screw or other device may be employed to lock the control arm 20 to the bridge 18. This effectively converts the tremolo guitar into a hardtail guitar by locking the tremolo bridge into its "ZERO" position. This prevents the tremolo increasing the string tensions, for example if or when there may have been enough strings already broken to cause the remaining strings to be tensioned above their normal tuned pitch. This locking of the tremolo bridge may be used when setting up the stringed instrument.

Figure 8:
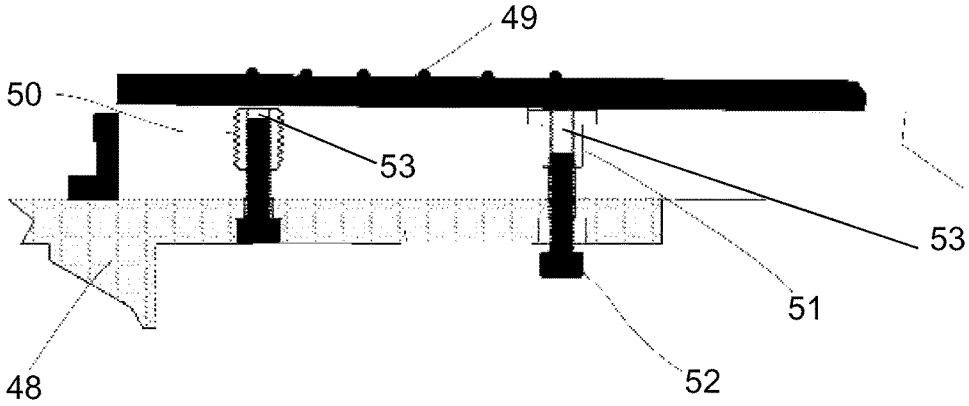
FIG. 8 is a diagrammatic view of the alternate attachment of the tremolo assembly to the guitar neck using metal inserts and bolts.

FIG. 8 shows an alternative embodiment for attaching the tremolo chassis 48 to the guitar neck 49 where wood screws are replaced by threaded metal inserts 50 or t-shaped metal inserts 51. Bolts 52 are located within the threaded recesses 53 of the inserts 50 and 51.

The tremolo assembly as described in the preferred embodiment can be retro-fitted to an existing guitar, assembled as part of a new guitar or sold as a kit to replace the tremolo system of an existing guitar.

Alternate pivot arrangements may be used in different embodiments. Preferably a low friction pivot arrangement is used to provide a responsive tremolo.

Figure 9:
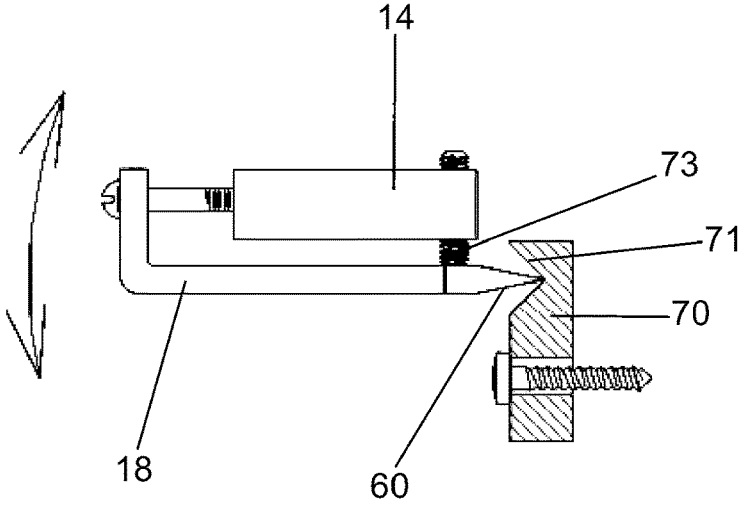
FIG. 9 is a diagrammatic view of a bearing mechanism for the tremolo bridge.
Figure 10:
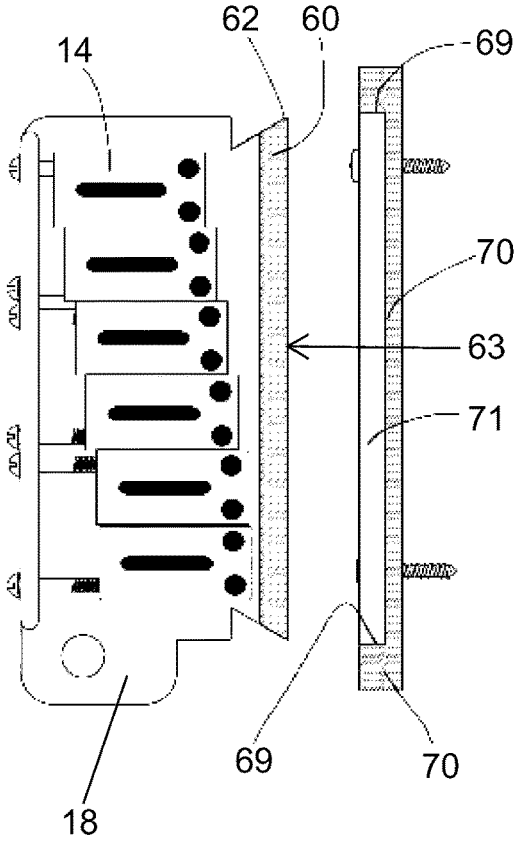
FIG. 10 is a further diagrammatic view of the bearing mechanism for the tremolo bridge.

FIGS. 9 and 10 show a low friction pivot arrangement of the present invention. The low friction pivot arrangement illustrated in FIGS. 9 and 10 utilizes a knife-edge bearing 60 fitted to a bearing block 70. The bearing block 70 defines a 'Vee' bearing mount point 71 within which the knife-edge bearing 60 is received. The knife-edge bearing 60 comprises part of the bridge 18, and the bearing block 70 comprises part of the tremolo chassis 19.

The edge 63 of the machined knife-edge bearing 60 defines a fulcrum bar (instead of a traditional screw fulcrum) and keeps the fulcrum contact axes parallel to the bridge 18. The knife-edge bearing 60 also improves the strength and wearing properties of the fulcrum parts of the guitar. The inbuilt parallelism of the machined knife-edge bearing 60 helps to reduce the friction of the hinging parts.

The machined knife-edge bearing 60 is designed to allow the pivot to take higher static and dynamic loads than ball bearings and roller bearings, and still remain near friction free. The knife-edge bearing 60 removes the need for lubricant, and is not affected by temperature. Lateral positioning and lateral play can be adjusted by moving side bearing blocks (where fitted).

To pivot, the bridge rotates about the knife-edge bearing 60. By virtue of the minimal contact surface area between the edge of the knife-edge bearing 60 and the bearing mount point 71, a significantly lower amount of friction is experienced compared to conventional arrangements.

The knife-edge bearing 60 further defines lateral knife points 62 which assist in locating the bridge 18 laterally between internal side walls 69 that delimit the edges of the 'Vee' bearing mount point 71.

The 'Vee' bearing mount point 71 may be horizontal and parallel to the plane of the guitar neck, but may also be at a non-parallel angle thereto.

In one variation, the 'Vee' bearing mount point 71 is angled such that it is higher on one side compared to an opposite side. The corresponding knife-edge bearing 60 and hence tremolo chassis 19, when received into the angled 'Vee' bearing mount point 71, will therefore also be higher on one side. Such an arrangement is particularly suited to a guitar with a six a side machine head.

On the normal six a side machine head arrangement as found on guitars such as the Fender Stratocaster the string lengths usually differ in length. Usually the higher pitched strings are found to be longer than the lower pitched strings, and therefore need to be stretched more to produce the same pitch change as the lower pitched strings.

To compensate for this, the machined knife-edge bearing 60 may be designed with an altered pivot axis. The pivot axis, which is normally at right-angles to a long axis of the neck and parallel to a fret board surface), may be altered so as to increase the string height to the pivot axis for the longer strings and lower the height of the strings to the pivot axis for the shorter strings. When the tremolo is used, the longer strings that have the increased string height to the pivot axis will be stretched over a greater distance. Accordingly, all strings will be subject to a similar change in pitch when the tremolo is used.

By laterally tilting the pivot axis so that it is higher on the shorter string side and lowered on the longer string side of the bridge, and by adjusting the string heights so that each is at a comfortable and similar playing height over the fret board, a variation of string heights to the pivot axis is produced. This leveling out of the strings is achieved by lowering the bridge saddles 14 for the shorter strings while raising the bridge saddles 14 for the longer strings. Lowering and raising of the bridge saddles is achieved through adjustment of saddle set screws 73.

Similarly, the variation of string heights to the pivot axis inter string pitch compensation, may be adopted when alternate pivot arrangements are used.

The tremolo chassis allows the guitar to be set up during the manufacturing process without the need for the finished body to be attached. This helps prevent the body from being damaged. Without the body being attached, the tremolo can be assembled and attached to the chassis or the chassis and the neck. The guitar can be strung to pitch and the neck set up for playing. A locating block can then be positioned and bolted to the chassis against the heel of the neck. This locating block can be made as a part of the chassis or preferably bolted to the chassis so that it can be adjusted firmly up against the heel of the neck. This locating bock allows the neck to be removed and accurately re-bolted in place on the chassis of the guitar, and this may be achieved even when the strings are under tension. This removal and re-bolting of the neck is a normal practice when the guitar truss rod needs adjusting or at times when the guitar is transported in the non-air-conditioned cargo holds of modern airliners.

Advantages

An advantage of the preferred embodiment of the tremolo is that a single tension adjustment of the tremolo mechanism of this invention converts the guitar from one with a tremolo action to a guitar with a "hard tail" style action. A variation of this tension adjustment gives a variation between these styles.

Often when a string or stings on a tremolo are bent as part of the guitarists playing style, the remaining unbent strings are influenced by the subsequent movement of the floating bridge and they lose their tension and thus reduce their pitch.

With the current preferred embodiment the strings do not move extensively over the bridge, and there is reduced string wear when the tremolo is used. Furthermore the amount of bending of the strings is low and the strings are less likely to break.

If the tremolo is adjusted appropriately and a string does break, the remaining strings of the guitar can be played with little or no effect on the tuned pitch of the remaining intact strings. This is because the bridge (when properly adjusted prior the string breakage) will not move unless activated by the guitarist.

The tremolo mechanism may be adjusted so that the guitar can be played with a floating tremolo or as a fixed or hard tail guitar.

A number of pivots may be used for this invention, including solid bearings, ball or roller bearings or machined knife-edge bearings. Using a knife-edge bearing reduces friction between the tremolo bridge and the tremolo chassis when the tremolo is used.

As the bridge saddles of this invention are attached to the bridge in a similar way the saddles are attached on the Fender Stratocasters, the strings at the bridge are raised when the tremolo moves to reduce the string tension. Conversely they drop in height (the action is lowered) when the tremolo moves to increase the string tension. This is beneficial to the playing of a stringed instrument when a tremolo is operated. When the strings are reduced in tension they oscillate in large arcs and can then touch the frets and will thereby promote an annoying buzzing against these said frets. When the strings stretch they oscillate in smaller arcs but the power of the oscillation in less and the volume produced via the pickups is reduced, so reducing the action and bringing the string closer to the pickups helps to maintain the volume of the stringed instrument.

A "built in" handle on the tremolo allows the guitarist to activate the tremolo without the need for the removable tremolo arm to be fitted.

The tremolo chassis may be made of metal. A metal chassis can be used to add stability to the guitar. It will help to maintain the tuned pitch of the guitar in a manner similar to that experienced by using a metal harp in a modern piano as opposed to that used in the older wooden harped piano. The metal chassis is more stable compared to existing wooden bodied guitars that are much more affected by the weather and ambient temperature. The metal in a metal chassis is more dense then the timber of a wooden guitar and tends to sustain a plucked note for longer. It maintains the strings tuned pitch more reliably. The metal chassis stiffens the body of the guitar. It does not stiffen the neck of the guitar that is usually made using timber, although it does increase the rigidity of the neck to body attachment.

The metal chassis forms the backbone of the body of the guitar. The body may be made thinner because the body is not required to be a structural part of the guitar. The body may be made of different materials, even soft, flexible materials.

Because of a metal chassis a guitar may be made much thinner than a solid wooden bodied equivalent, as such it allows more and different configurations of electronic pickups to be used without sacrificing body stiffness. An appropriate metal chassis would have reduced the flex and the guitar would remain in tune for longer periods.

Because the metal chassis design makes for a stiffer guitar, the guitar can be made lighter than existing all timber bodied guitar.

The metal chassis and the above mentioned tremolo mechanism allow the body of the guitar to be manufactured so that no visible holes, screws or fixtures are present on the back side of the body to improve aesthetics and making manufacture simpler.

The metal chassis can and should be earthed to then become part of the electronic shielding of the guitar. This earthing may be done while incorporating a small value fast blow fuse between the Jacks earth and the chassis (and strings) to prevent electrical shock.

The metal chassis allows the guitar to be assembled with it's neck and strings set up and tuned to pitch prior to attaching the electronics and the guitar body. This helps in the processes of manufacture and helps reduce the chance of scratching or other physical damage to the body.

The tremolo may be designed and used without a metal chassis so that it can be fitted to, or retrofitted to a Fender Stratocaster type guitar or other type of guitar.

Scratch plates with all of the electronics attached makes it easy to repair and change the pickup and electronic configurations. This modular package would include, the volume and tone pots, the pickups, the switching, jacks and other electronics components. As all of the electronic components are attached to the scratch plate, and if a fault occurs, this modular style allows for the replacement of whole electronic package by simply removing its attachment screws and fitting another electronic package without having to disconnect or de-solder any connections.

Metal attachment inserts are screwed into the guitar neck positioned under the fret/finger board. The fret board is glued to the neck after the inserts are screwed into position. The Inserts are close to or in contact with the glued or under surface of the fret/finger board. This makes for a stronger and more rigid attachment between the body (or the metal chassis) of the guitar and the guitar neck.

The metal inserts may be either of the "screw in" type (where the inserts are made with a large diameter external screw thread that screws into the timber, with a smaller metal thread cut internally to allow the attachment of machined metal thread bolts). By inserting, screwing, and/or gluing the threaded inserts into the guitar neck before then gluing the finger board to the neck, the inserts are prevented from unwinding from the neck at a time when the necks attaching machined metal thread bolts are removed.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

The invention claimed is:

1. A tremolo assembly for a guitar including a tremolo chassis;

a bridge pivotally attached to the tremolo chassis, said bridge includes a saddle and a plurality of ferrules for guiding and securing strings;

bridge tension arrangement connecting the tremolo chassis to the bridge and providing balancing tension with the strings;

a controller arm pivotally attached to the tremolo chassis and engaged with the bridge;

a controller arm stop member to locate the controller arm and engaged bridge in a neutral position;

controller arm tension arrangement connecting the controller arm to the tremolo chassis and urging the controller arm towards the controller arm stop member; and an activation member to pivot the bridge between upward and downward positions relative to the tremolo chassis, wherein the controller arm in cooperation with the controller arm stop member and the controller arm tension arrangement can be engaged with the bridge to locate the bridge to the neutral position after pivoting between the upward and downward positions.

2. A tremolo assembly as claimed in claim 1 wherein the bridge tension arrangement includes a bridge spring attached to the bridge.

3. A tremolo assembly as claimed in claim 2 wherein the bridge spring is connected to a bridge spring adjustment member which is attached to the tremolo chassis, the tension of the bridge spring is adjustable by adjusting the bridge spring adjustment member.

4. A tremolo assembly as claimed in claim 1 wherein the controller arm is pivotally connected to the bridge and the tremolo chassis.

5. A tremolo assembly as claimed in claim 4 wherein the pivotal connection of the controller arm is the same pivotal connection between the bridge and the tremolo chassis.

6. A tremolo assembly as claimed in claim 1 wherein the controller arm stop member is attached to the tremolo chassis.

7. A tremolo assembly as claimed in claim 6 wherein the controller arm stop member is adjustable.

8. A tremolo assembly as claimed in claim 1 wherein the controller arm tension arrangement includes a controller arm spring attached to the controller arm.

9. A tremolo assembly as claimed in claim 8 wherein the controller arm spring is connected to a controller arm spring adjustment member which is attached to the tremolo chassis.

10. A tremolo assembly as claimed in claim 9 wherein the tension of the controller arm spring is adjustable by adjusting the controller arm spring adjustment member.

11. A tremolo assembly as claimed in claim 10 wherein the controller arm spring adjustment member can be adjusted to substantially prevent movement of the controller arm and thus movement of the engaged bridge.

12. A tremolo assembly as claimed in claim 10 wherein the controller arm spring adjustment member can be adjusted to substantially prevent movement of the controller arm and thus upward movement of the engaged bridge.

13. A tremolo assembly as claimed in claim 1 wherein the bridge tension arrangement is adjusted so that the engaged bridge is in the neutral position abutting the controller arm when the strings are tuned.

14. A tremolo assembly as claimed in claim 1 wherein the tension of the controller arm tension arrangement is large enough to overcome any mechanical friction and will ensure the controller arm will urge the bridge to return to the neutral position.

15. A tremolo assembly as claimed in claim 1 wherein the tension of the bridge tension arrangement is adjusted to balance the tension of the strings so that the bridge in an upward pivotal position can return to the neutral position.

16. A tremolo assembly as claimed in claim 1 wherein the activation member is a bar or an elongate member extending from the bridge.

17. A tremolo assembly as claimed in claim 1 wherein the activation member is a handle forming part of the bridge.

18. A tremolo assembly as claimed in claim 1 wherein there are two or more activation members.

19. A tremolo assembly as claimed in claim 1 wherein the tremolo chassis is attached to the neck of the guitar by a plurality of screws or metal inserts and bolts.

20. A tremolo assembly as claimed in claim 1 wherein the plurality of ferrules are substantially adjacent or proximal to the saddle and positioned so that the strings are subject to minimal bending.

21. A tremolo assembly as claimed in claim 1 wherein the bridge is substantially T-shaped with a laterally extending engagement portion near one end, and said engagement portion is shaped to abut and engage with the controller arm.

22. A tremolo assembly as claimed in claim 1 wherein the tremolo assembly can be retro-fitted to guitars.

23. A tremolo assembly for a guitar including a tremolo chassis a bridge pivotally attached to the tremolo chassis, said bridge includes a saddle and a plurality of ferrules for guiding and securing strings;

bridge tension arrangement connecting the tremolo chassis to the bridge and providing balancing tension with the strings;

a controller arm pivotally attached to the tremolo chassis and engaged with the bridge;

a controller arm stop member to locate the controller arm and engaged bridge in a neutral position;

controller arm tension arrangement connecting the controller arm to the tremolo chassis and urging the controller arm towards the controller arm stop member; and an activation member to pivot the bridge between upward and downward positions relative to the tremolo chassis, wherein the tension of the controller arm tension arrangement is large enough to overcome any mechanical friction and will ensure the controller arm will urge the bridge to return to the neutral position, and the tension of the bridge tension arrangement is adjusted to balance the tension of the strings so that the bridge in an upward pivotal position can return to the neutral position.

24. A tremolo assembly as claimed in claim 23 wherein the controller arm in cooperation with the controller arm stop member and the controller arm tension arrangement can be engaged with the bridge to locate the bridge to the neutral position after pivoting between the upward and downward positions.

25. A tremolo assembly kit including a tremolo chassis;

a bridge pivotally attached to the tremolo chassis, said bridge includes a saddle and a plurality of ferrules for guiding and securing strings;

bridge tension arrangement connecting the tremolo chassis to the bridge and providing balancing tension with the strings;

a controller arm pivotally attached to the tremolo chassis and engaged with the bridge;

a controller arm stop member to locate the controller arm and engaged bridge in a neutral position;

controller arm tension arrangement connecting the controller arm to the tremolo chassis and urging the controller arm towards the controller arm stop member; and an activation member to pivot the bridge between upward and downward positions relative to the tremolo chassis, wherein the controller arm in cooperation with the controller arm stop member and the controller arm tension arrangement can be engaged with the bridge to locate the bridge to the neutral position after pivoting between the upward and downward positions.

26. A stringed instrument having the tremolo assembly as claimed in claim 1.

27. A guitar having the tremolo assembly as claimed in claim 1.

* * * * *